US010194735B2

(12) United States Patent
Moskovich et al.

(10) Patent No.: US 10,194,735 B2
(45) **Date of Patent: *Feb. 5, 2019**

(54) TOOTHBRUSH

(71) Applicant: COLGATE-PALMOLIVE COMPANY, New York, NY (US)

(72) Inventors: Robert A. Moskovich, East Brunswick, NJ (US); Joachim Storz, Zell am See (AT); Tanja Langgner, London (GB); Thomas Kuchler, Zell am See (AT)

(73) Assignee: Colgate-Palmolive Company, New York, NY (US)

( * ) Notice: Subject to any disclaimer, the term of this patent is extended or adjusted under 35 U.S.C. 154(b) by 505 days.

This patent is subject to a terminal disclaimer.

(21) Appl. No.: 14/679,289

(22) Filed: Apr. 6, 2015

(65) Prior Publication Data

US 2015/0208797 A1 Jul. 30, 2015
US 2017/0332773 A9 Nov. 23, 2017

Related U.S. Application Data

(63) Continuation of application No. 14/252,911, filed on Apr. 15, 2014, now Pat. No. 9,038,229, which is a (Continued)

(51) Int. Cl.
*A46B 9/04* (2006.01)
*A46B 5/00* (2006.01)
(Continued)

(52) U.S. Cl.
CPC ..... *A46B 5/0029* (2013.01); *A46B 5/026* (2013.01); *A46B 7/06* (2013.01); *A46B 9/04* (2013.01); *A46B 2200/1066* (2013.01)

(58) Field of Classification Search
USPC ..... 15/167.1, 187, 191.1
See application file for complete search history.

(56) References Cited

U.S. PATENT DOCUMENTS 301,644 A 7/1884 Thompson
1,058,273 A 4/1913 Thompson
(Continued)

FOREIGN PATENT DOCUMENTS

DE 199 49 671 4/2001
RU 2026626 1/1995
(Continued)

OTHER PUBLICATIONS

International Search Report and the Written Opinion issued in International Patent Application PCT/US2007/087141 dated Mar. 18, 2008.

*Primary Examiner* — Joseph J Hail
*Assistant Examiner* — Shantese McDonald

(57) ABSTRACT

A toothbrush includes a handle and a head mounted to the handle. In one aspect, the head may extend from a proximal end to a distal end along a longitudinal axis, the head having a base portion formed of a rigid plastic material and a flexible portion formed of an elastomeric material, a first longitudinal section of the flexible portion spaced apart from the base portion by a gap. The flexible portion of the head may have an upper surface and an opposing lower surface such that within the first longitudinal section of the flexible portion the upper surface and the lower surface are substantially planar and parallel to one another. Furthermore, tooth cleaning elements may be secured to the flexible portion of the head by in-molded technology to extend from the upper surface of the flexible portion.

19 Claims, 13 Drawing Sheets

Related U.S. Application Data continuation of application No. 11/611,726, filed on Dec. 15, 2006, now Pat. No. 8,695,148, which is a continuation-in-part of application No. 11/053,583, filed on Feb. 8, 2005, now Pat. No. 7,360,270, which is a continuation of application No. PCT/US03/24878, filed on Aug. 8, 2003.

(60) Provisional application No. 60/402,162, filed on Aug. 9, 2002, provisional application No. 60/402,670, filed on Aug. 12, 2002, provisional application No. 60/402,170, filed on Aug. 9, 2002.

(51) Int. Cl.
*A46B 5/02* (2006.01)
*A46B 7/06* (2006.01)

(56) References Cited

U.S. PATENT DOCUMENTS 1,128,139 A 2/1915 Hoffman
1,191,556 A 7/1916 Blake
1,588,785 A 6/1926 Van Sant
1,616,484 A 2/1927 Beynon
1,688,581 A 10/1928 Glassman
1,924,152 A 8/1933 Coney et al.
1,928,328 A * 9/1933 Carpentier ..... A46B 5/0025 15/167.1
2,003,243 A 5/1935 Campbell et al.
2,148,483 A 2/1939 Love et al.
2,176,309 A 10/1939 Love et al.
2,676,350 A 4/1954 Bressler
2,706,825 A * 4/1955 Blakeman ..... A46B 5/0029 15/167.1
3,129,449 A 4/1964 Cyzer
3,739,419 A 6/1973 Natman et al.
3,766,590 A 10/1973 Wachtel
4,240,452 A 12/1980 Jean
1,500,939 A 2/1985 Gueret
4,520,526 A 6/1985 Peters
5,146,645 A 9/1992 Dirksing
5,228,466 A 7/1993 Klinkhammer
5,325,560 A 7/1994 Pavone et al.
5,355,546 A * 10/1994 Scheier ..... A46B 5/0029 15/167.1
5,390,984 A 2/1995 Boucherie et al.
5,435,032 A 7/1995 McDougall
5,454,133 A 10/1995 Garnet
5,481,775 A 1/1996 Gentile et al.
5,483,722 A 1/1996 Scheier et al.
5,524,312 A 6/1996 Tan et al.
5,581,840 A 12/1996 Chen
5,625,916 A 5/1997 McDougall
5,630,244 A 5/1997 Chang
5,651,158 A 7/1997 Halm
5,813,079 A 9/1998 Halm
RE35,941 E 11/1998 Stansbury, Jr.
5,839,149 A 11/1998 Scheier et al.
5,946,759 A 9/1999 Cann
5,970,564 A 10/1999 Inns et al.
6,000,083 A 12/1999 Blaustein et al.
D421,843 S 3/2000 Joergensen
D428,260 S 7/2000 Harada
6,088,870 A 7/2000 Hohlbein
D430,401 S 9/2000 Harada
D431,366 S 10/2000 Harada
6,129,449 A 10/2000 McCain et al.
6,141,817 A * 11/2000 Dawson ..... A46B 5/0025 15/167.1
6,185,779 B1 2/2001 Krämer
D450,929 S 11/2001 Angelini et al.
D467,081 S 12/2002 Harada
6,641,764 B2 11/2003 Lanvers
6,779,851 B2 * 8/2004 Bouchiere ..... A46D 3/04 15/167.1
6,807,703 B2 10/2004 Van Gelder et al.
6,810,551 B1 11/2004 Weihrauch
6,832,819 B1 12/2004 Weihrauch
6,938,294 B2 9/2005 Fattori et al.
6,988,777 B2 1/2006 Pfenniger et al.
7,036,179 B1 * 5/2006 Weihrauch ..... A46B 3/20 15/167.1
2003/0033679 A1 2/2003 Fattori et al.
2003/0140440 A1 7/2003 Gavney, Jr.
2004/0117934 A1 * 6/2004 Pfenniger ..... A46B 3/06 15/167.1
2005/0091767 A1 5/2005 Jimenez et al.
2005/0091769 A1 5/2005 Jimenez et al.
2005/0138744 A1 6/2005 Hohlbein
2005/0188487 A1 9/2005 Moskovich
2005/0188488 A1 9/2005 Moskovich
2005/0193512 A1 9/2005 Moskovich et al.
2006/0080795 A1 4/2006 Pfenniger et al.
2006/0130257 A1 6/2006 Cann
2007/0151058 A1 7/2007 Georgi et al.

FOREIGN PATENT DOCUMENTS

WO WO 1994/13174 6/1994
WO WO 00/40115 7/2000
WO WO 2006/012956 2/2006

* cited by examiner

TOOTHBRUSH

CROSS REFERENCE TO RELATED APPLICATIONS

This application is a continuation of U.S. patent application Ser. No. 14/252,911, filed Apr. 15, 2014, now U.S. Pat. No. 9,038,229, issued May 26, 2015, which is a continuation of U.S. patent application Ser. No. 11/611,726, filed Dec. 15, 2006, now U.S. Pat. No. 8,695,148, issued Apr. 15, 2014, which is a continuation-in-part of U.S. patent application Ser. No. 11/053,583, filed Feb. 8, 2005, now U.S. Pat. No. 7,360,270, issued Apr. 22, 2008, which is a continuation of Application No. PCT/US03/24878, filed Aug. 8, 2003, which claims the benefit of U.S. Provisional Application No. 60/402,162, filed Aug. 9, 2002. The contents of the aforementioned applications are incorporated herein by reference. Application No. PCT/US03/24878 also claims the benefit of U.S. Provisional Application No. 60/402,170, filed Aug. 9, 2002 and U.S. Provisional Application No. 60/402,670, filed Aug. 12, 2002.

FIELD OF THE INVENTION

The present invention is directed to a manually held and operated toothbrush or to a powered toothbrush which includes a handle and a head.

BACKGROUND OF THE INVENTION

The head of a conventional toothbrush usually has a flat or slightly altered surface to which cleaning elements are attached. Usually the cleaning elements are strands of plastic material(s) formed into tufts or other groupings. The strand groupings are attached to the head either before or after forming the toothbrush handle.

Various attempts have been made for providing flexibility to the manner in which the bristles are attached. Various approaches have also been taken wherein the bristle carrying surface of the head is not flat. U.S. Pat. No. 1,688,581, for example, discloses a toothbrush having a bristle carrying member which is ordinarily bowed inwardly into the hollow head. The bristle carrying member can be bowed outwardly by manipulating a wire mounted in the toothbrush.

BRIEF SUMMARY OF THE INVENTION

The present invention pertains to a toothbrush having an oral care region attached to a handle. The oral care region has a base portion and a flexible portion that provides flexible movement of tooth cleaning elements.

In one aspect, the invention may be a toothbrush comprising: a handle; a head extending from a proximal end to a distal end along a longitudinal axis, the head comprising a base portion formed of a rigid plastic material and a flexible portion formed of an elastomeric material coupled to the base portion, a first longitudinal section of the flexible portion spaced apart from the base portion by a gap that forms a transverse passageway through the head from a first side of the head to a second side of the head; the flexible portion of the head having an upper surface and an opposing lower surface, wherein within the first longitudinal section of the flexible portion the upper surface and the lower surface are substantially planar and parallel to one another; and tooth cleaning elements secured to the flexible portion of the head by in-molded technology and extending from the upper surface of the flexible portion.

In another aspect, the invention may be a toothbrush comprising: a handle; a head extending from a proximal end to a distal end along a longitudinal axis, the head comprising a base portion formed of a rigid plastic material and a flexible portion formed of an elastomeric material, the flexible portion of the head fixedly coupled to the base portion of the head; a first longitudinal section of the flexible portion spaced apart from the base portion by a gap, a second longitudinal section of the flexible portion coupled to the base portion at the distal end of the head, and a third longitudinal section of the flexible portion coupled to the base portion at the proximal end of the head, the first longitudinal section of the flexible portion being located between the second and third longitudinal sections of the flexible portion; the flexible portion of the head having an upper surface and an opposing lower surface, wherein an entirety of the upper surface of the flexible portion is substantially planar and at least a portion of the lower surface of the flexible portion located within the first longitudinal section of the flexible portion is substantially planar and parallel to the upper surface of the flexible portion; the base portion of the head having a top surface adjacent to the gap and an opposing bottom surface, and wherein the top surface is concave and the bottom surface is convex; and tooth cleaning elements secured to the flexible portion of the head by in-molded technology, the tooth cleaning elements comprising a first tooth cleaning element having a first length measured from the upper surface of the flexible portion to a proximal end and a second tooth cleaning element having a second length measured from the upper surface of the flexible portion to a proximal end, the first length being greater than the second length.

DETAILED DESCRIPTION OF THE INVENTION

Figure 2:
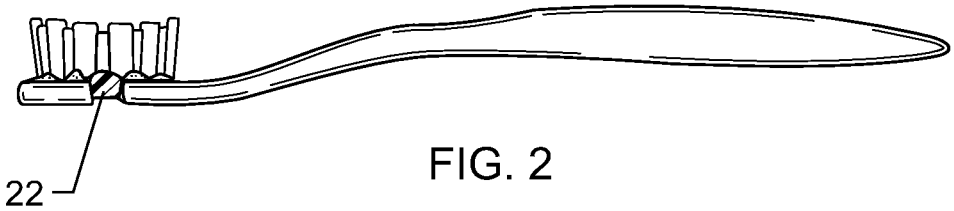
FIG. 2 is a side elevational view of the toothbrush shown in FIG. 1.
Figure 3:
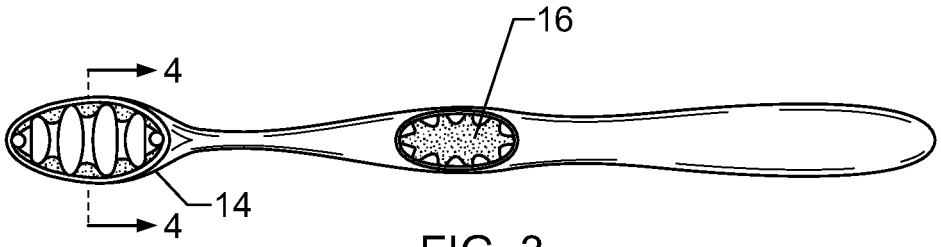
FIG. 3 is a front elevational view of the toothbrush shown in FIGS. 1-2.
Figure 4:
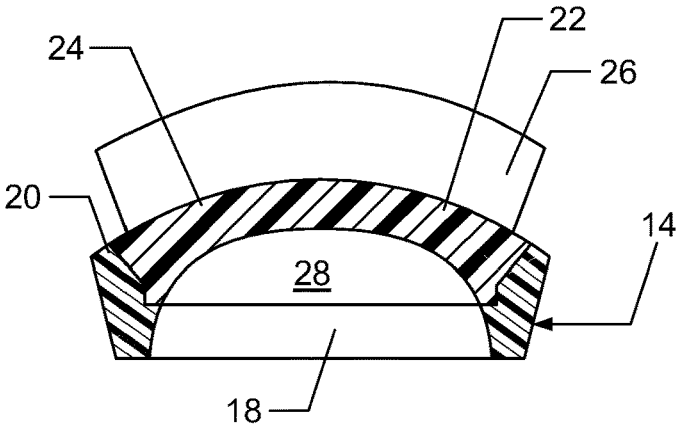
FIG. 4 is a cross-sectional view taken through FIG. 3 along the line 4-4.

FIGS. 1-4 illustrate a toothbrush 10 in accordance with one embodiment of the invention. As shown therein, toothbrush 10 includes a handle 12 and a head 14. Handle 12 may include a suitable grip pad 16 made of an elastomer material. The focus of this improvement is primarily directed to the structure of head 14. As shown in FIG. 4, head 14 has a base portion 18 with an upstanding wall 20 to create a peripheral frame extending outwardly above base portion 18. In one embodiment, a membrane 22 is attached to frame 20 completely along its periphery. Membrane 22 in its initial non-use condition is convex or bowed outwardly as best shown in FIG. 4. The convex bowing is provided both in the longitudinal and transverse directions, thus presenting a dome-like outer surface 24 to which cleaning elements 26 are connected.

In one embodiment, cleaning elements in the form of strands or bristles are attached via in-molded technology (IMT) methods. The strands utilizing IMT methods are preferably attached during formation of the toothbrush handle or at least during formation of the head which is the portion of the toothbrush to which the strands and other materials are attached. Referring to FIGS. 1-4 and FIG. 5, the use of thin cross-sections of material for membrane 22 so that it is flexible and resilient. The cross-section shown, for example, in FIG. 4 is formed like a moon crescent thus representing a shape similar to the dome.

Alternatively, the toothbrush is particularly suitable for cleaning elements in the form of strands or bristles attached via anchor free tufting (AFT). In the AFT toothbrush brush making process, described in detail in U.S. Pat. No. 6,779,851, nylon is fed into a pre-molded plate that can be made from any thermoplastic or elastomer material or combination thereof. This nylon may be processed into bristle tufts of various sizes and shapes. The non-use or proximal end of the nylon is heated and melted to retain the nylon in the brush head when a reasonable pulling force is applied. This head plate may then be ultrasonically welded to a pre-molded handle that has a peripheral wall or frame on which the head plate will rest and become fused to the handle.

Because of the open space 28 between base portion 18 and membrane 22, the membrane displaces from its original dome-like shape to be distorted into other shapes as the cleaning elements or bristles 26 contact the teeth of a user. Thus, the dome 22 has a thin membrane of material or combinations of material that can flex to become altered from its original shape and recover to its original shape randomly during brushing. The bristles 26 are attached to the flexible dome and move accordingly, creating a random topology and by doing so, improves the cleaning of the teeth. The moving bristle strands have more degrees of motion than other toothbrushes and thus represent a different and unique tooth brushing device.

Referring to FIG. 3, in the illustrated embodiment, the head 14 is generally oval shape and the membrane 22 has a corresponding oval shape. Any suitable form of cleaning elements may be used as the cleaning elements 26 in the broad practice of the invention. The term "cleaning elements" is intended to be used in a generic sense which could include conventional fiber bristles or massage elements or other forms of cleaning elements such as elastomeric fingers or walls arranged in a circular cross-sectional shape or any type of desired shape including straight portions or sinusoidal portions. Where bristles are used, the bristles could be mounted to tuft blocks or sections by extending through suitable openings in the tuft blocks so that the base of the bristles is mounted within or below the tuft block and below membrane 22.

It is to be understood that the specific illustration of the cleaning elements is for exemplary non-limiting purposes. The toothbrush can be provided with various combinations of the same or different cleaning element configurations (such as stapled or in-molded technology bristles, anchor free technology (AFT), etc.) and/or with the same bristle or cleaning element materials (such as nylon bristles, spiral bristles, rubber bristles, etc.). Similarly, while FIG. 2 illustrates the cleaning elements to be generally perpendicular to the outer surface 24 membrane 22 or head 14 some or all of the cleaning elements may be angled at various angles with respect to the outer surface of head 14. It is thereby possible to select the combination of cleaning element configurations, materials and orientations to achieve specific intended results to deliver additional oral health benefits, like enhanced cleaning tooth polishing, tooth whitening and/or massaging of the gums.

Figure 1:
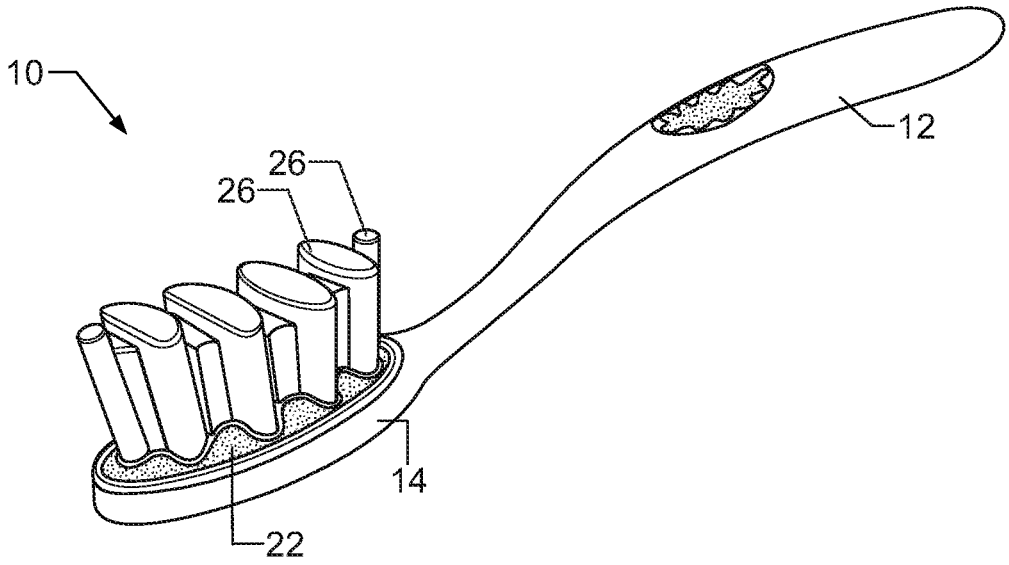
FIG. 1 is a perspective view of a toothbrush.

In one embodiment, cleaning elements 26 are IMT bristles. Although FIGS. 1-3 illustrate the membrane 22 to occupy generally the entire head 14, the invention may be practiced where the head 14 is of sufficient size that it could include other bristle carrying surfaces adjacent to the dome shape membrane 22.

Although FIGS. 1-4 illustrate a manually operated toothbrush, an embodiment may also be practiced where the head includes one or more power or electrically operated movable sections carrying cleaning elements. Such movable section may oscillate in a rotational manner or may oscillate linearly in a longitudinal direction with respect to the longitudinal axis of the head or may oscillate linearly in a lateral or transverse direction with respect to the longitudinal axis of the head. The movable section may oscillate in and out in a direction toward and away from the outer surface of the head. The movable section may rock back and forth with respect to the outer surface of the head. The movable section may rotate continuously in the same direction, rather than oscillate. Any suitable drive mechanism may be used for imparting the desired motion to the movable section. Where plural movable sections are used, all of the movable sections may have the same type and direction of movement, or combinations of different movements may be used.

Figure 5:
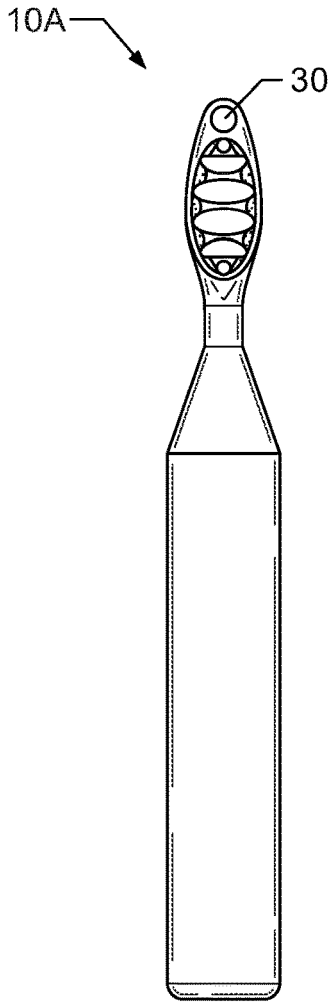
FIG. 5 is a front elevational view of a powered toothbrush.

FIG. 5 illustrates a toothbrush 10A which includes a power driven movable disc or section 30 having cleaning elements. The movable section 30 could be oscillated rotationally such as by using the type of drive mechanism shown in U.S. Pat. No. 5,625,916, or could move in and out using the type of drive mechanism shown in U.S. Pat. No. Re 35,941, all of the details of both patents are incorporated herein by reference thereto. Alternatively, the other types of drives referred to above could move section 30 in other manners and directions. Although FIG. 5 shows movable section 30 to be at the distal end of the head, the movable section(s) could be located at any desired location on the head.

Handle 12, base 18 and frame 20 are preferably made of hard plastic materials which are used for manual toothbrushes. As noted, however, a characteristic of dome shape membrane 22 is that it is made of a flexible resilient material such as an elastomer capable of being moved from its original position and then returning to that original position.

Membrane 22 may be secured to frame 20 in any suitable manner. Thus, for example, frame 20 includes inwardly inclined surfaces for receiving membrane 22. Other structural arrangements may be used within the practice of this invention to mount membrane 22 on head 14.

Figure 9:
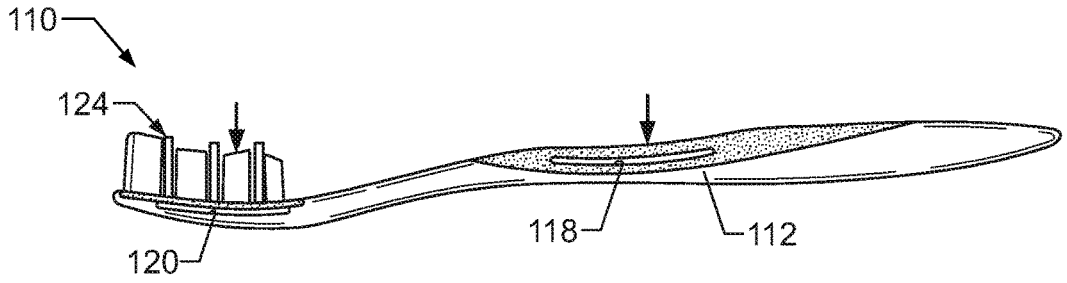
FIG. 9 is a side elevational view of the toothbrush of FIG. 6 showing deflection in the open area under the bristles and the handle area.

FIGS. 6-9 illustrate a manual toothbrush 10 in accordance with another embodiment. This is a variation of the prior embodiment using a trampoline type structure to achieve an up and down motion. As shown therein toothbrush 110 includes a handle 112 and a head 114. Handle 112 may include a suitable area 116 made of an elastomeric material. This elastomeric portion of the handle is preferably molded with an open area 118 which is readily deformable by the user. The elastomeric material 16 on the top side of the handle 12 (as viewed in FIGS. 6, 7 and 9) will yield under pressure of the user's fingers to provide a better grip on the handle while providing a more comfortable feel to the handle. FIG. 9 illustrates this elastomeric portion 116 of the handle 112 in a depressed state. The downward arrow in this Figure represents the pressure applied by the toothbrush user. The open area 118 is thereby minimized. As soon as the user's pressure is released, the properties of the elastomeric portion 116 of the handle 112 return the elastomeric material 116 to its original shape illustrated in FIG. 6.

A similar flexible, deformable open area 120 is created in the head by inclusion of an elastomeric portion 122 in the head overlying open area 120. Cleaning elements 124 are arrayed in the elastomeric portion of the head and fastened thereto by known methods including in-molded technology (IMT). Bristle attachment utilizing IMT methods generally occurs during formation of the toothbrush handle or at least during formation of the elastomeric portion 122 of the head 114.

In use, the application of pressure by the toothbrush user causes a like pressure of the teeth against cleaning elements 124 as illustrated by the arrow in FIG. 9. This causes deflection of the elastomeric portion 122 of head 114 which in turn causes a reorientation of cleaning elements relative to the teeth being cleaned. As the user's pressure is reduced, the open area 120 of head 114 opens up causing the cleaning elements to follow the shape of the teeth being brushed and thereby improving the cleaning of the teeth. When all user pressure is released, the open area 120 returns to its original shape.

The elastomeric portion 122 of head 114 should be a material or combinations of material that can flex to become altered from its original shape and recover to its original shape randomly during brushing. The cleaning elements, for example, bristles, are attached to the flexible membrane creating a flexible orientation of cleaning elements 124 which improves the cleaning of the teeth. The moving bristle strands have considerable degrees of motion and thus provide a unique tooth brushing experience.

Figure 7:
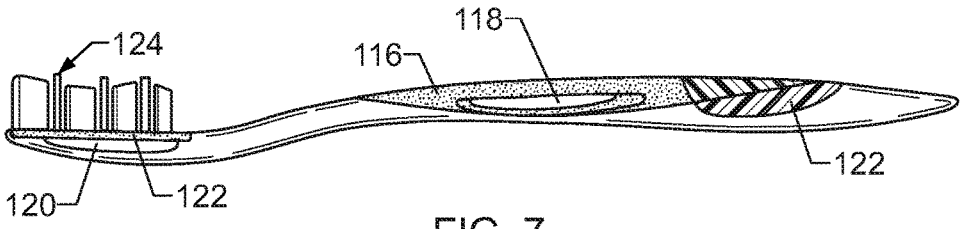
FIG. 7 is a side elevational view of the toothbrush shown in FIG. 6.
Figure 8:
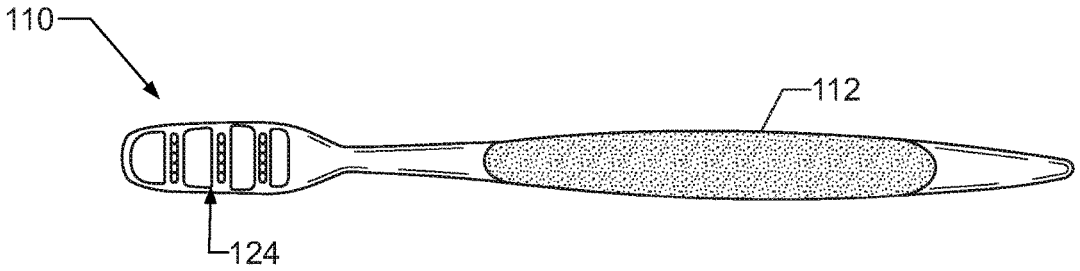
FIG. 8 is a top plan view of the toothbrush shown in FIGS. 6-7.

Any suitable form of cleaning elements may be used as the cleaning elements 124 in the broad practice of this invention, as discussed with the embodiments of FIGS. 1-5. It is to be understood that the specific illustration of the cleaning elements is merely for exemplary purposes. The invention can be practiced with various combinations of the same or different cleaning element configurations (such as stapled, in-molded technology bristles, or AFT, etc.) and/or with the same bristle or cleaning element materials (such as nylon bristles, spiral bristles, rubber bristles, etc.) Similarly, while FIGS. 7 and 9 illustrates the cleaning elements to be generally perpendicular to the elastomeric portion 122 of head 114, some or all of the cleaning elements may be angled at various angles. It is thereby possible to select the combination of cleaning element configurations, materials and orientations to achieve specific intended results to deliver additional oral health benefits, like enhanced cleaning, tooth polishing, tooth whitening and/or massaging of the gums.

Portions of handle 112 and head 114, may be made of a rigid plastic material which is used for manual toothbrushes. As noted, however, a feature of this toothbrush is use of elastomeric portions 116 of the handle and/or elastomeric portion 122 of head 114, such as an elastomer capable of being moved from its original position and then returning to its original position.

An embodiment may also be practiced where the head 114 includes one or more power or electrically operated movable sections carrying cleaning elements.

Figure 10:
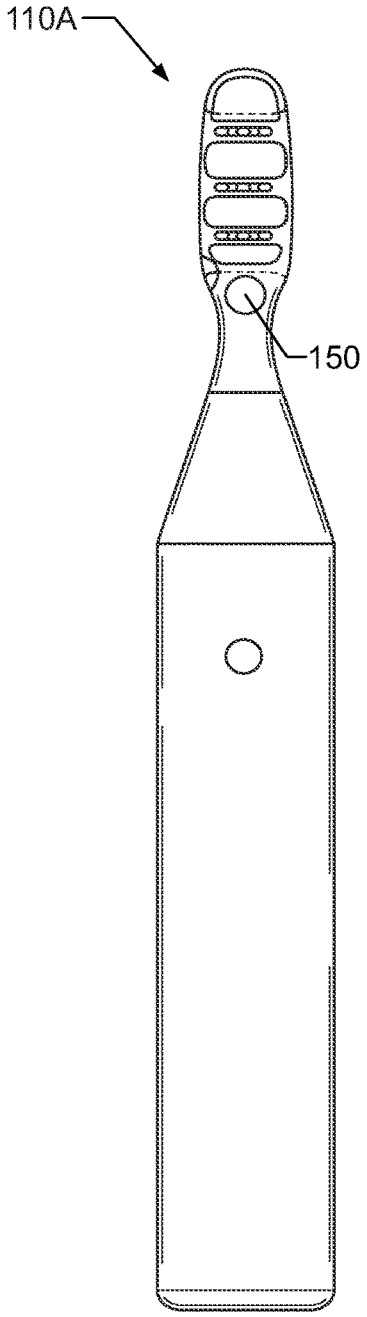
FIG. 10 is a top plan view of a powered toothbrush in accordance with the embodiment of FIGS. 6-9.

FIG. 10 illustrates a toothbrush 110A which includes a power driven movable disc or section 150 having cleaning elements. The movable section 150 could be similar to section 30 of FIG. 5. Although FIG. 10 shows movable section 150 to be at the one end of the head, as with FIG. 5, the movable section(s) could be located at any desired location on the head.

Figure 11:
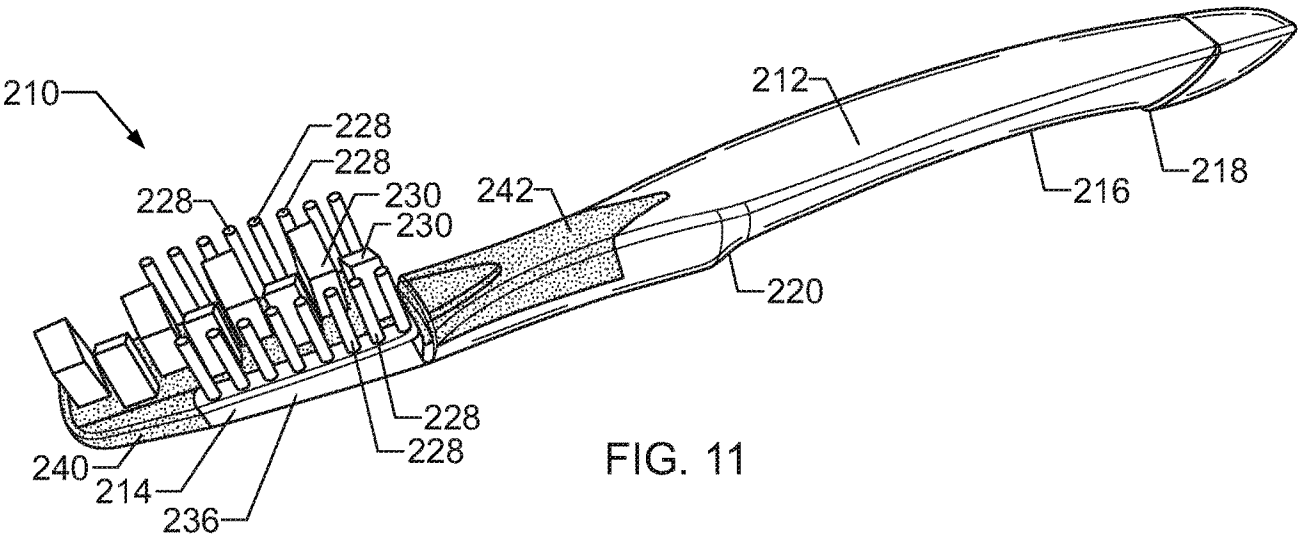
FIG. 11 is a perspective view of a toothbrush formed in accordance with still another embodiment.
Figure 12:
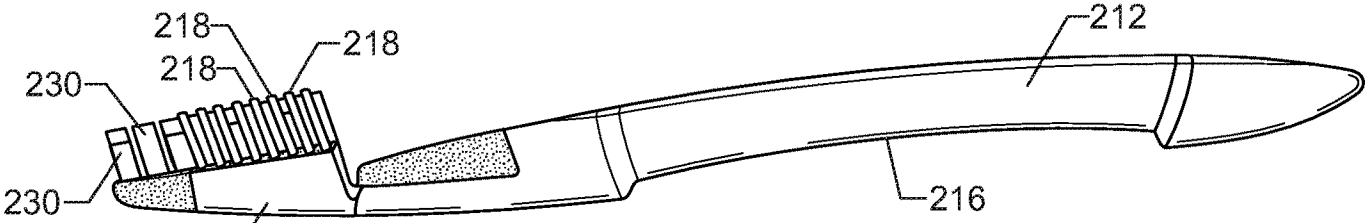
FIG. 12 is a side elevational view of the toothbrush shown in FIG. 11.
Figure 13:
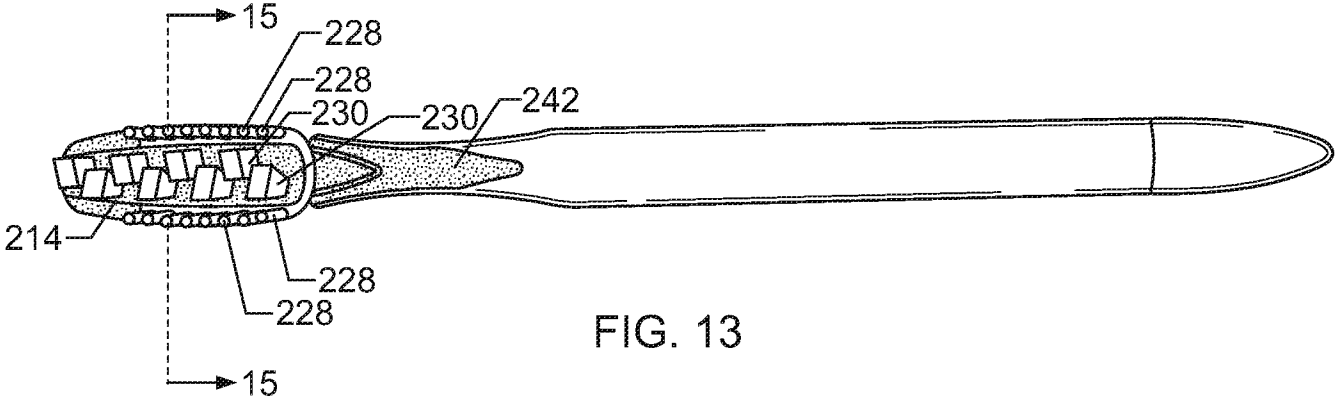
FIG. 13 is a top plan view of the toothbrush shown in FIGS. 11-12.

In another embodiment, a toothbrush includes a head longitudinally separated into side by side areas by means of a flexible hinge structure that serves as a spring to return the brush head materials and cleaning areas to their original position. FIGS. 11-13 illustrate a toothbrush 210 which includes an elongated handle 212 and a head 214. A portion of handle 212 may be recessed at gripping area 216 between shoulders 218 and 220. Shoulder 218 could extend outwardly a sufficient distance to act as a hook or ledge to facilitate hanging the toothbrush in an inverted condition.

Figure 14:
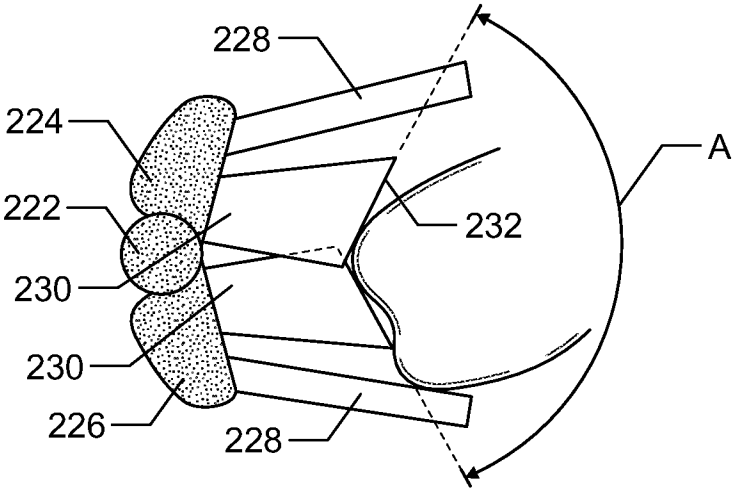
FIG. 14 is an end elevational view of the toothbrush shown in FIGS. 11-13 in its original closed position.
Figure 15:
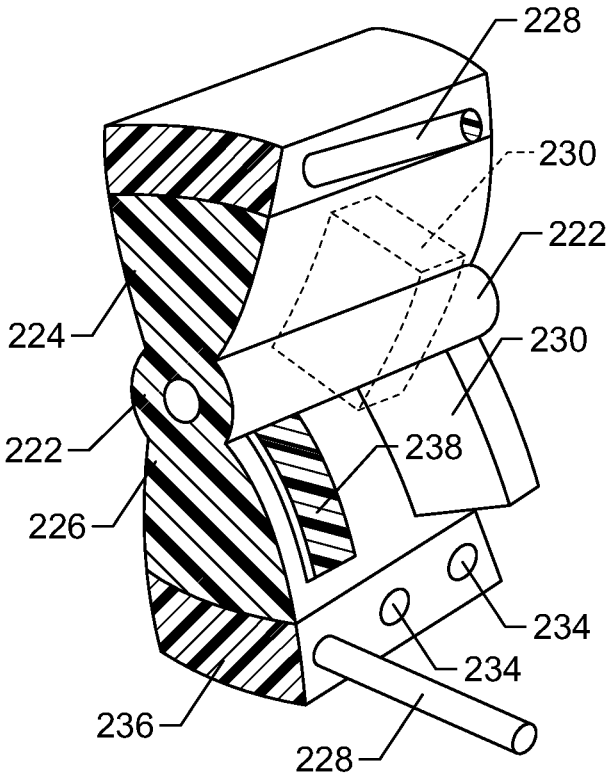
FIG. 15 is a cross-sectional view taken through FIG. 13 along the line 15-15, but with the brush head in its hinged open position and omitting some of the cleaning elements.
Figure 16:
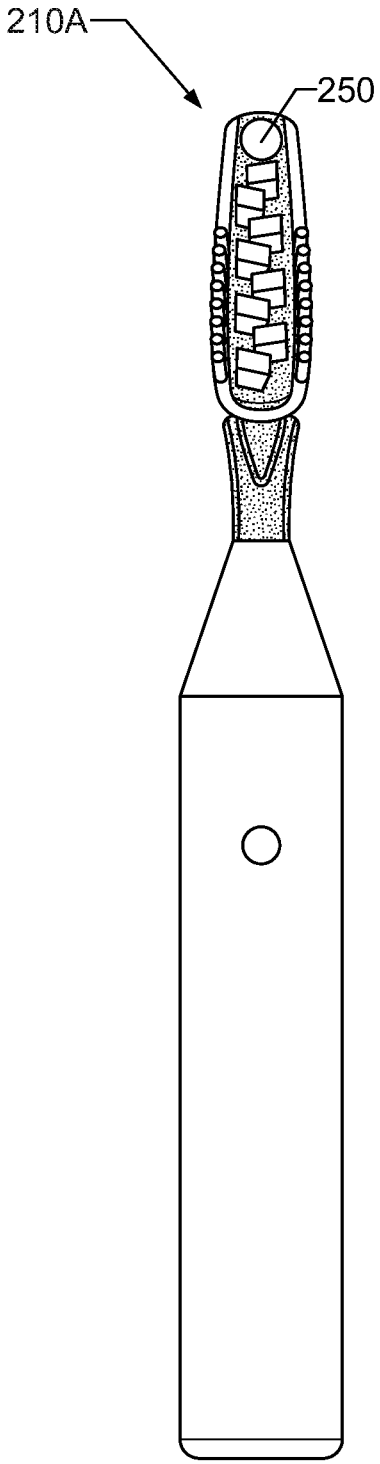
FIG. 16 is a front elevational view of a powered toothbrush in accordance with the embodiment of FIGS. 11-15.

Head 214 and handle 212 are elongated and have a longitudinal axis. As shown in FIGS. 14 and 15, head 214 includes a spine 222 which extends collinear with the longitudinal axis or major axis of the toothbrush handle and head. As a result, head 214 is separated into two side by side longitudinal sections 224, 226 connected to the spine 222. Spine 222 is made of a resilient material such as an elastomer which is sufficiently flexible as to be movable and yet return to its original position. As a result, spine 222 functions as a hinge axis whereby the side by side sections 224, 226 may move or pivot about the spine away from the original position shown in FIG. 14 to an open position such as shown in FIG. 15 when the cleaning elements on the sections 224, 226 contact the teeth. Then sections 224, 226 return to their original position under the influence of the resilient hinge or spine 222. Preferably hinge or spine 222 is confined to head 214.

As illustrated, each of the sections 224, 226 includes sets of cleaning elements. For example, an outer set of cleaning elements 228 is located at the outer periphery of each section 224, 226 while an inner set of cleaning elements 230 is located closer to the spine 222. Preferably, the terminal surfaces 232 of the inner cleaning elements 230 are tapered toward the hinge axis 222 so that the adjacent terminal ends 232 of each inner set of cleaning elements forms an obtuse angle as indicated by the letter A in FIG. 14 when the brush head is in its original position.

The outer sets of cleaning elements 228 extend outwardly a longer distance from the outer surface of the sections than do the inner cleaning elements 230. As a result, the combined cleaning elements are designed to wrap around the edge of the teeth for simultaneous possible contact with both the front and top of the teeth. See FIG. 14. During use the brush head is pressed against the edge of the teeth causing the flexible hinge to open and close during cleaning.

As illustrated in FIGS. 11-13 in a preferred practice of the invention the outer sets of cleaning elements 228 are bristle bundles of plaque bristles. The inner sets of cleaning elements 230 may be bristles formed by in-molded technology (IMT) where sets of bristles are fused together at one end and the fused end is inserted in a mold cavity during the manufacture of the head.

FIG. 15 shows the sections 224,226 in their open position. FIG. 15 omits some of the cleaning elements so as to provide a better understanding of how the cleaning elements are mounted. As shown therein, the plaque bristles 228 are in the form of bristle bundles or tufts inserted into individual holes 234 in bristle container 236. The inner sets of cleaning elements 230 are IMT bristles mounted in IMT container 238. The IMT containers 238 may be made of soft flexible elastomer material integral with hinge axis 222, as shown in FIG. 15.

As shown in FIGS. 11-13 the bristle container 236 does not extend completely to the distal end of the head 214. Accordingly, side plates 240 are provided on each side of the head longitudinally abutting against bristle containers 236 and disposed against containers 238 for the remaining length of containers 238 so that a smooth contour results along the side of the head 214. Side plates 240 may also be made of a soft, flexible elastomer material.

As best shown in FIGS. 11-12 each inner row of IMT bristles 230 has its bristles spaced apart or staggered so that the inclined IMT bristles of each section may fit between the spacing of adjacent IMT bristles of the other section.

Although FIGS. 11-15 illustrate a preferred form of cleaning elements to be the plaque bristles and IMT bristles, any suitable form of cleaning elements may be used as the cleaning elements 228 and 230 as previously described. Thus the term "cleaning elements" is intended to be used in a generic sense which could include conventional fiber bristles or massage elements or other forms of cleaning elements such as elastomeric fingers or walls arranged in a circular cross-sectional shape or any type of desired shape including straight portions or sinusoidal portions. Where bristles are used, the bristles could be mounted to tuft blocks or sections by extending through suitable openings in the tuft blocks so that the base of the bristles is mounted within or below the tuft block.

Similarly, it is to be understood that the specific illustration of the cleaning elements is for exemplary non-limiting purposes. An embodiment can be practiced with various combinations of the same or different cleaning element configurations (such as stapled or IMT bristles, AFT, etc.) and/or with the same bristle or cleaning element materials (such as nylon bristles, spiral bristles, rubber bristles, etc.) Similarly, while FIG. 12 illustrates the cleaning elements to be generally perpendicular to the outer surface of head 214 some or all of the cleaning elements may be angled at various angles with respect to the outer surface of head 214. It is thereby possible to select the combination of cleaning element configurations, materials and orientations to achieve specific intended results to deliver additional oral health benefits, like enhanced cleaning tooth polishing, tooth whitening and/or massaging of the gums.

Handle 212 could be made of a conventional hard plastic material which could, however, include a soft elastomer section 242 near the head 214. Bristle containers 236,236 could also be made of a hard plastic material while side plates 240 and IMT containers 238 are made of a soft elastomer material. By having the bristle containers 236 mounted against the IMT containers 238, the bristle containers 236 and their cleaning elements 228 move along with the movement of the IMT containers 238 in response to the IMT bristles 230 contacting the teeth. If desired, the bristle containers 236 may also be made of a soft elastomer material.

Figure 6:
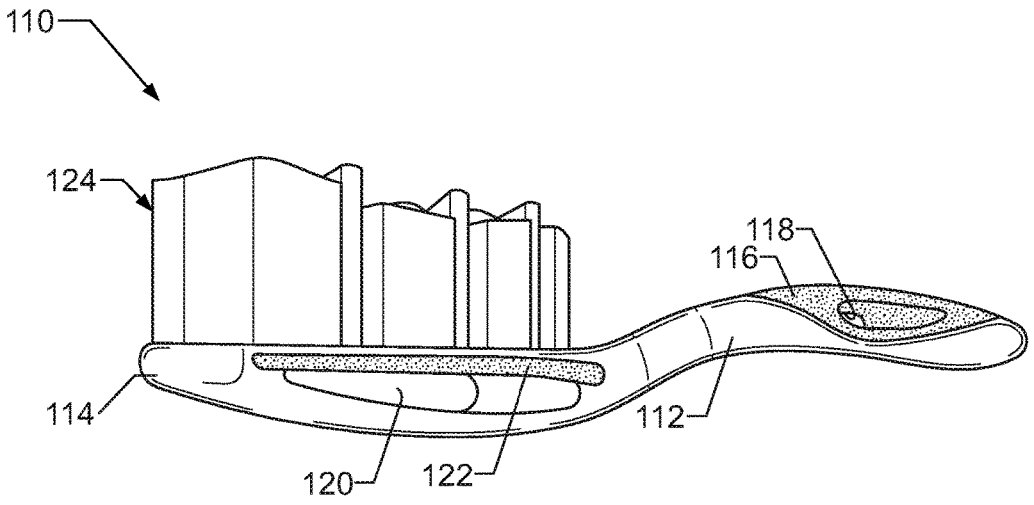
FIG. 6 is a perspective view of a toothbrush having elastic areas in the head and handle to allow deflection of the brush, bristles and handle for better teeth cleaning and control in accordance with a further embodiment.

Although FIGS. 11-13 illustrate a manually operated toothbrush, the invention may also be practiced where the head includes one or more power or electrically operated movable sections carrying cleaning elements. FIG. 6 illustrates a toothbrush 210 which includes a power driven movable disc or section 250 having cleaning elements, similar to the movable sections of toothbrushes 10A and 110A.

Figure 17:
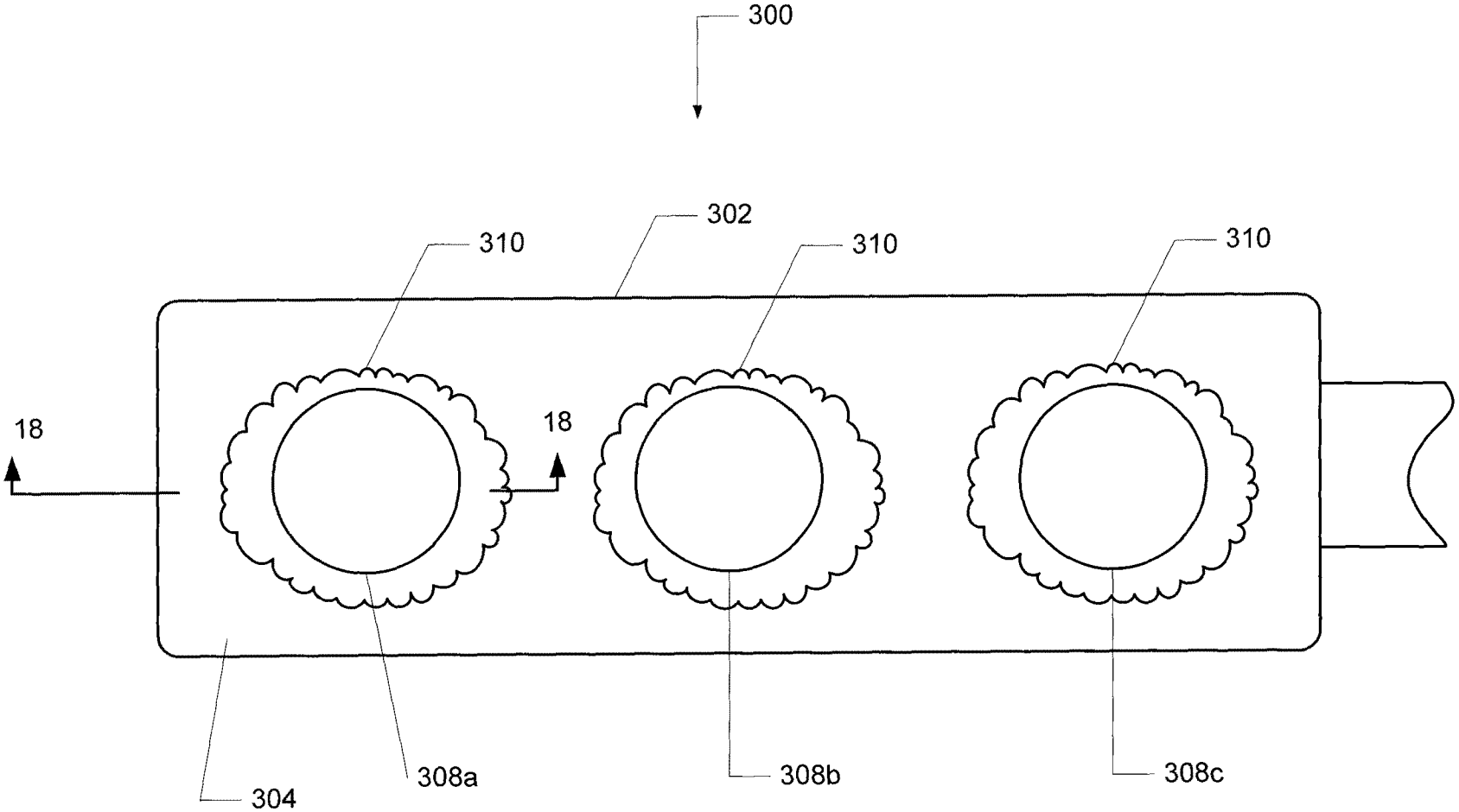
FIG. 17 is a rear view of a toothbrush head according to one embodiment.

FIG. 17 illustrates a toothbrush head according to yet another arrangement. The head comprises an oral care region for having elements for brushing teeth or tissue in the mouth. It should be noted that, although the toothbrush head shown in FIG. 17 is generally used with a manual toothbrush, the head and method of manufacturing the head, may also be used with a toothbrush that includes one or more power or electrically operated moveable sections carrying cleaning elements.

FIG. 17 illustrates a toothbrush head 300 having a peripheral wall or frame 302 as previously described with respect to FIG. 4. The toothbrush head 300 also includes an elastomeric membrane 304 that is connected to the peripheral frame 302 and provides a foundation to which various tooth cleaning elements may be mounted or otherwise attached. In addition, the head 300 includes tooth cleaning elements 308 mounted to the head 300 via the membrane 304. The term "cleaning elements" is intended to be used in a generic sense which could include conventional fiber bristles or massage elements or other forms of cleaning elements such as elastomeric fingers or walls arranged in a circular cross-sectional shape or any type of desired shape including straight portions or sinusoidal portions.

Figure 19:
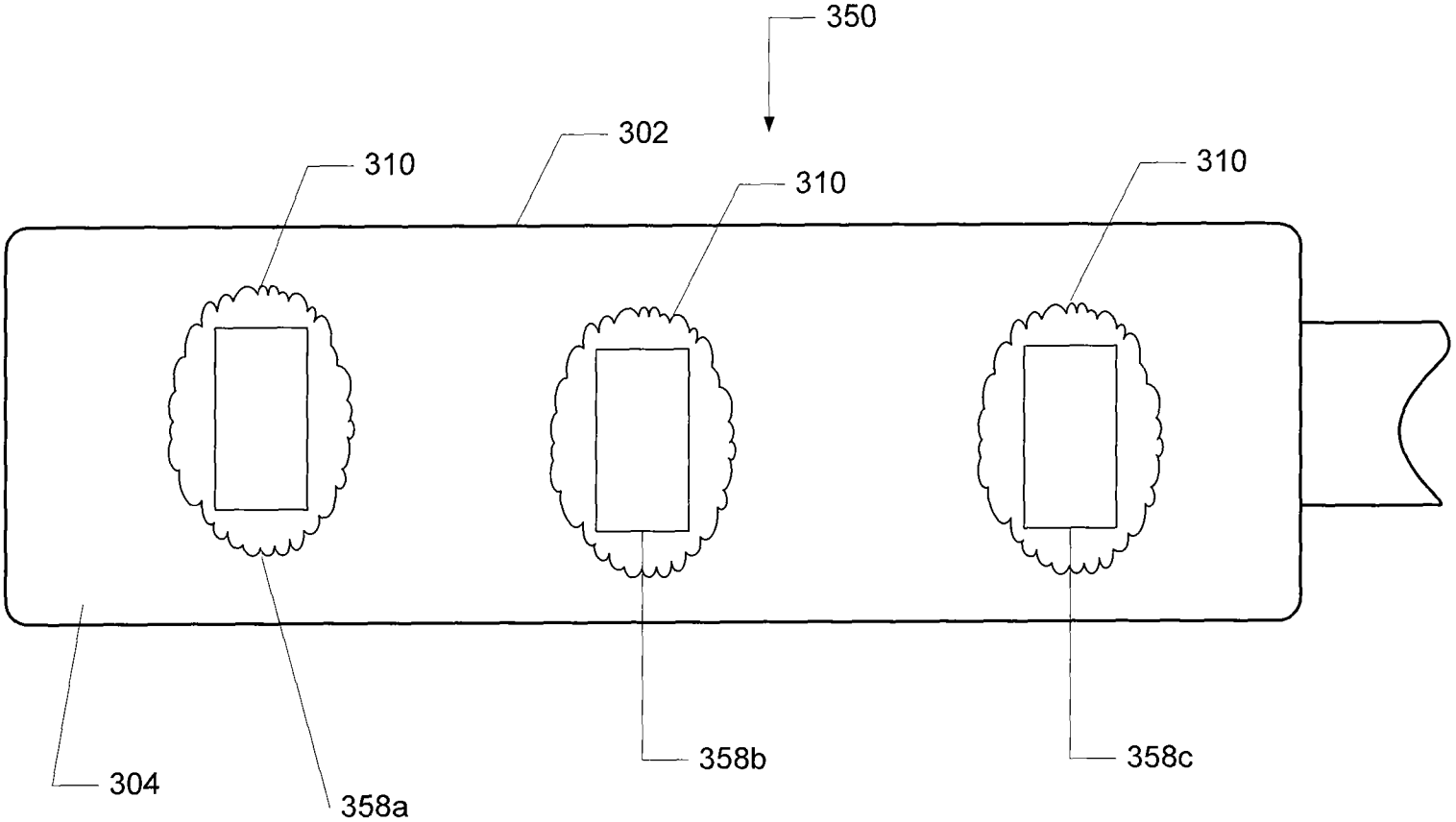
FIG. 19 is a rear view of an alternate arrangement of the toothbrush head of FIG. 17.

In the arrangement shown in FIG. 17, the tooth cleaning elements are mounted using Anchor Free Tufting (AFT) as described above. The tooth cleaning elements, such as bristle tufts or elastomeric members, are depicted as round in the FIG. 17. Nevertheless, tooth cleaning elements having alternate shapes may also be used. For example, shapes such as square, rectangular, etc., may be used, as shown in FIG. 19. During the AFT process, the tooth cleaning elements provides in a nylon material are heated and the proximal end of the tooth cleaning elements 308*a*, 308*b*, 308*c* melts to bind or fuse the tooth cleaning elements 308*a-c* to the membrane 304. A schematic representation of the molten nylon 310 is shown in FIG. 17 and FIG. 19. In FIG. 19, toothbrush 350 includes tooth cleaning elements 358*a*, 358*b*, 358*c* in a square shape.

Figure 18:
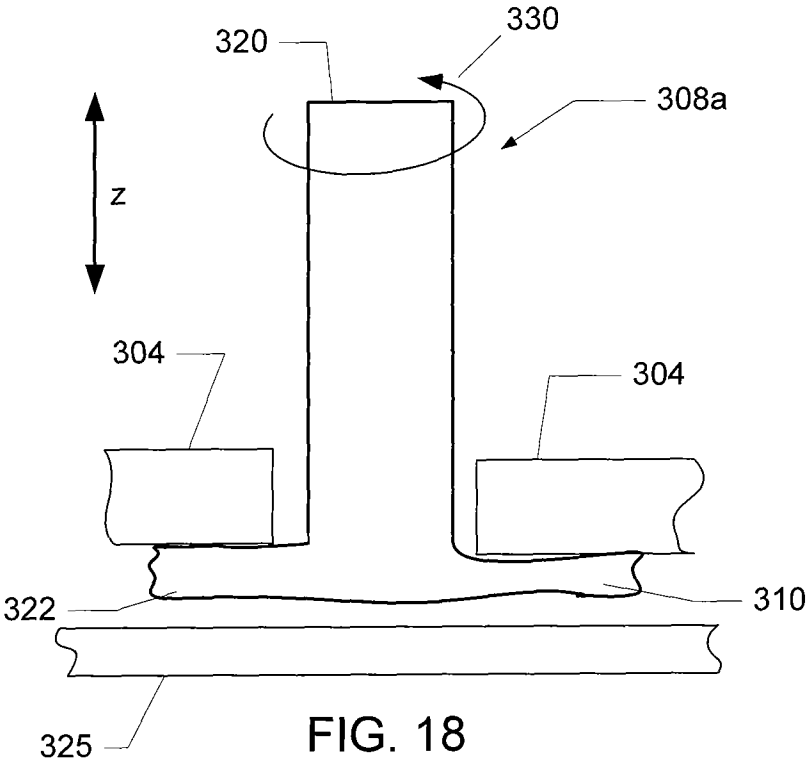
FIG. 18 is a cross-sectional view of a cleaning element of the toothbrush head of FIG. 17 taken along line 18-18.

FIG. 18 illustrates a tooth cleaning element 308 attached by anchor free tufting, for example. Tooth cleaning element 308 is visible with the distal end 320 at the top. The proximal end 322 is at the bottom and a portion of the proximal end 322 is shown as melted. This melting occurs when a heating element is applied and causes the nylon to fuse to the back side of the membrane 304. Elastomeric backing 325 is also shown. This backing 325 is attached to the backside of the head 300 and aids in sealing the head to prevent toothpaste and debris from collecting on the back side of the tooth cleaning elements.

Figure 20:
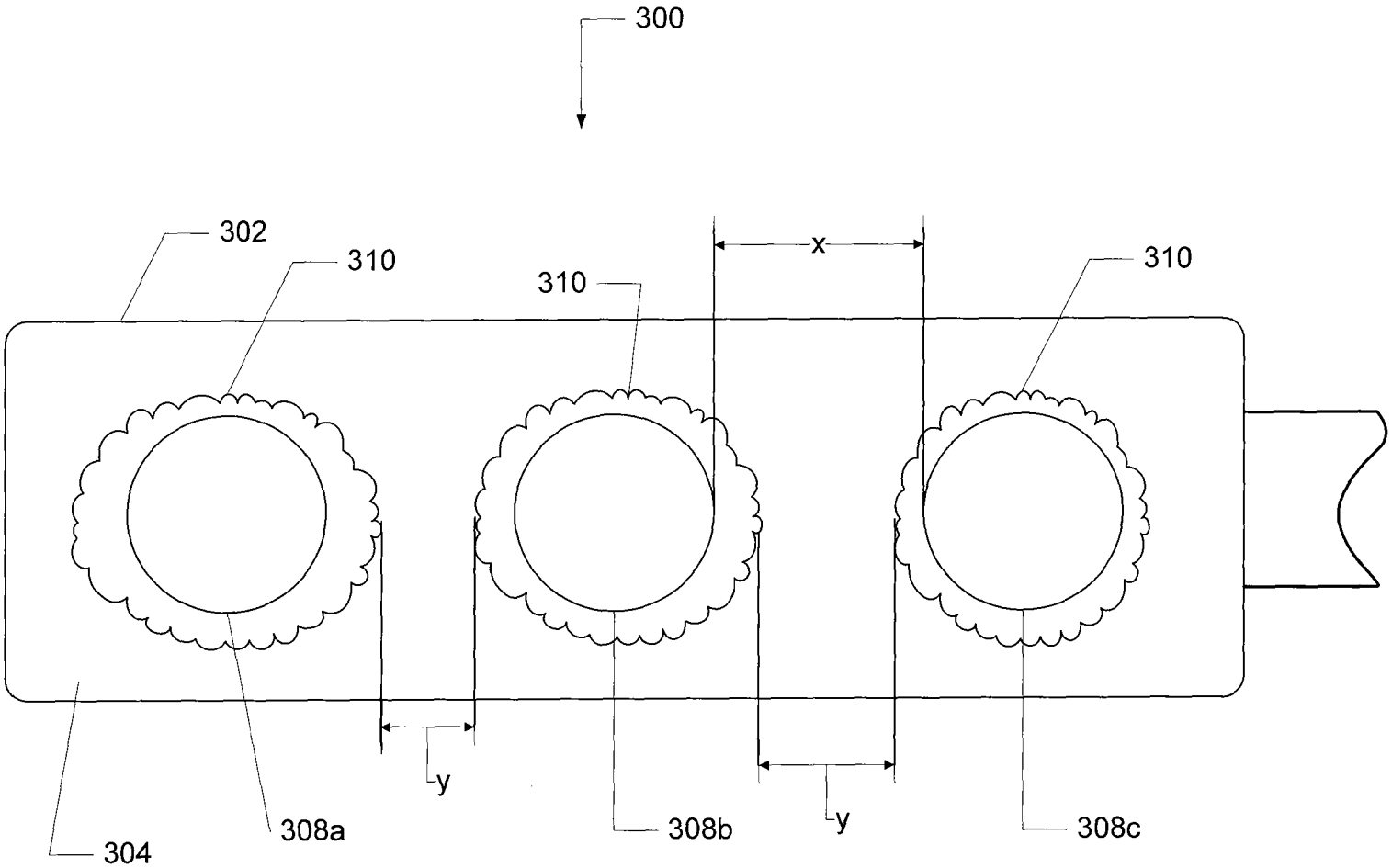
FIG. 20 is a rear view of the toothbrush head of FIG. 17 schematically illustrating additional features.

In one embodiment, to enable the tooth cleaning elements to move independently of each other, the molten nylon associated with each tooth cleaning element should be free of contact with molten nylon of other tooth cleaning elements. In the arrangement of FIGS. 17, 19 and 20 the tooth cleaning elements are spaced sufficiently apart so as to allow the molten nylon of each tooth cleaning element to be separate or isolated from the molten nylon of other tooth cleaning elements. For instance, in FIG. 20, tooth cleaning elements 308*a*, 308*b*, 308*c* may be spaced a distance "X" between the periphery tooth cleaning elements. In one embodiment, this spacing may be between 0.3 mm to 0.5 mm. Nevertheless, other values may be used. In addition, the edge of the molten nylon regions 310*a*, 310*b*, 310*c* may be separated from the neighboring molten nylon by a spacing "Y" having a range of values between 0.05 mm to 0.1 mm. Nevertheless, other values may be used. Aspects of the arrangements shown in FIGS. 17, 19 and 20 can be applied to the arrangements of toothbrushes shown in FIGS. 1-16.

To further enable movement of the tooth cleaning elements 308, a force in the z-direction is generally applied to the tooth cleaning elements after they have been heated and attached to the membrane 304. This force acts to loosen the attachment or detach the nylon at the perimeter of the head 300. The applied force is generally greater than the value of brushing forces during a normal brushing operation. In order to overcome this attachment, a plate may be lowered onto the head 300 via a pneumatic cylinder, mechanical movement, hydraulic cylinder, etc. This plate forces the nylon downward towards the elastomer on the back of the head. The plate is generally moved a predetermined distance at a predetermined force to break bonds of the nylon tooth cleaning element field from the perimeter of the head. This operation further enables the tooth cleaning elements to be resiliently flexible during brushing. Thus, the tooth cleaning elements 308*a-c* in the form of bristles are attached to the membrane and move accordingly, creating a random topology and by doing so, improves the cleaning of the teeth. The moving bristle strands have more degrees of motion than other toothbrushes and thus represent a different and unique tooth brushing device.

The toothbrush and tooth cleaning element arrangement described enables not only movement of the bristles independently of each other, but also allows movement of the membrane around the tooth during brushing. This arrangement provides of a compound movement of the tooth cleaning elements. For instance, the membrane 304 and tooth cleaning elements 308 may be resiliently flexible when brushing forces are applied. Such flexibility may include rotation of the distal tip of the tooth cleaning element through a 360 degree arc, as indicated by arrow 330 in FIG. 18. In addition, this flexibility may include z-axis compression of the membrane 304 and tooth cleaning elements 308, as shown in FIG. 18, to allow tooth cleaning elements to encompass the tooth. This movement facilitates enhanced brushing of the lingual and facial surfaces with the dentifrice retained on the tooth cleaning element. In addition, z-axis movement of the tooth cleaning elements facilitates improved interproximal cleaning as well as cleaning of the crowns of the molars.

Figure 21:
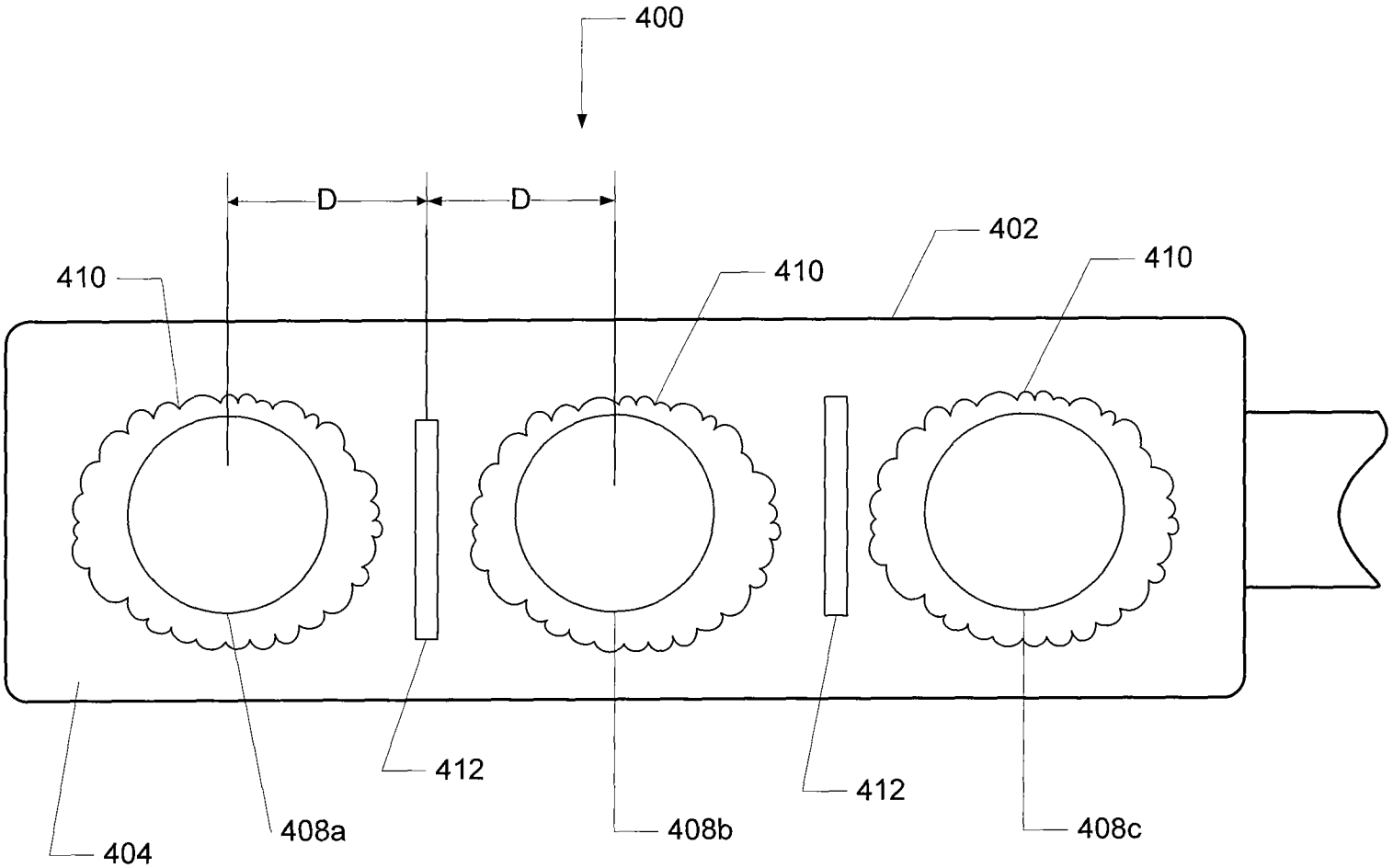
FIG. 21 is a rear view of a toothbrush head according to an alternate embodiment.

FIG. 21 illustrates a toothbrush head according to still another arrangement. The head 400 of FIG. 21 includes a peripheral wall or frame 402. The head 400 also includes an elastomeric membrane 404 connected to the peripheral frame 402 and provides a foundation to which various tooth cleaning elements may be mounted. In addition, the head 400 includes tooth cleaning elements 408*a*, 408*b*, 408*c* that are connected to the membrane 404 via molten nylon 410.

In the arrangement of FIG. 21, the head 400 includes a plurality of walls or dams 412. The walls 412 may be molded into the back of the head 400 and may act as a barrier for molten nylon 410. In one arrangement, the walls 412 are elastomeric and are molded into the back of the membrane 404. The walls 412 are generally directed downward, toward the back of the head 400 and in a direction opposite the tooth cleaning elements 408. To attach or mount the tooth cleaning elements by way of anchor free tufting, a heating element is applied to the tooth cleaning elements 408*a-c* and the proximal end of the tooth cleaning elements 408*a-c* will melt to the back side of the membrane 404. The molten nylon 410 will spread around the area of the tooth cleaning elements 408*a-c*. The walls 412 may be generally spaced a distance D from the center of the cleaning element, as shown in FIG. 23, to isolate the molten nylon of each tooth cleaning element 408*a-c* and prevent the molten nylon 410 of one tooth cleaning element from fusing with the molten nylon of another tooth cleaning element.

In the arrangement of FIG. 21, a single heating element may be used to apply high temperature to melt the nylon at a melt flow temperature. In an alternate arrangement, separate heating elements may be used for each tooth cleaning element in order to prevent the wall 412 from coming in contact with the heating element. In yet another arrangement, one heating element may be used, however, this heating element may include machine areas such that no contact is made with the nylon tooth cleaning elements in designated areas.

Figure 22:
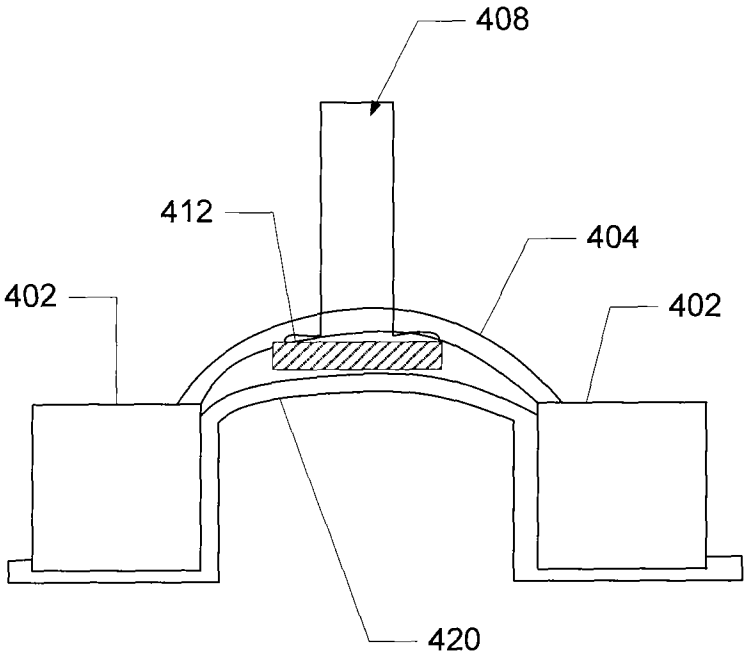
FIG. 22 is a cross-sectional view of a barrier wall of the toothbrush head of FIG. 21.

FIG. 22 is a cross-sectional view of the arrangement of FIG. 21. The peripheral frame 402 is shown with the membrane 404 attached. In addition, the wall or dam 412 is shown molded into the membrane 404 and extending downward toward the back of the head 400. Shown behind the molded wall 412 is a tooth cleaning element 408. The molten nylon attaching the tooth cleaning element to the head 400 is not visible since the wall 412 prevents the molten nylon from flowing around it. In addition, a backing 420 is shown. The backing may comprise an elastomeric material and generally seals the head 400 from the backside (e.g., opposite of the tooth cleaning elements) to prevent dentifrice and debris from collecting on the underside of the tooth cleaning elements.

Figure 23:
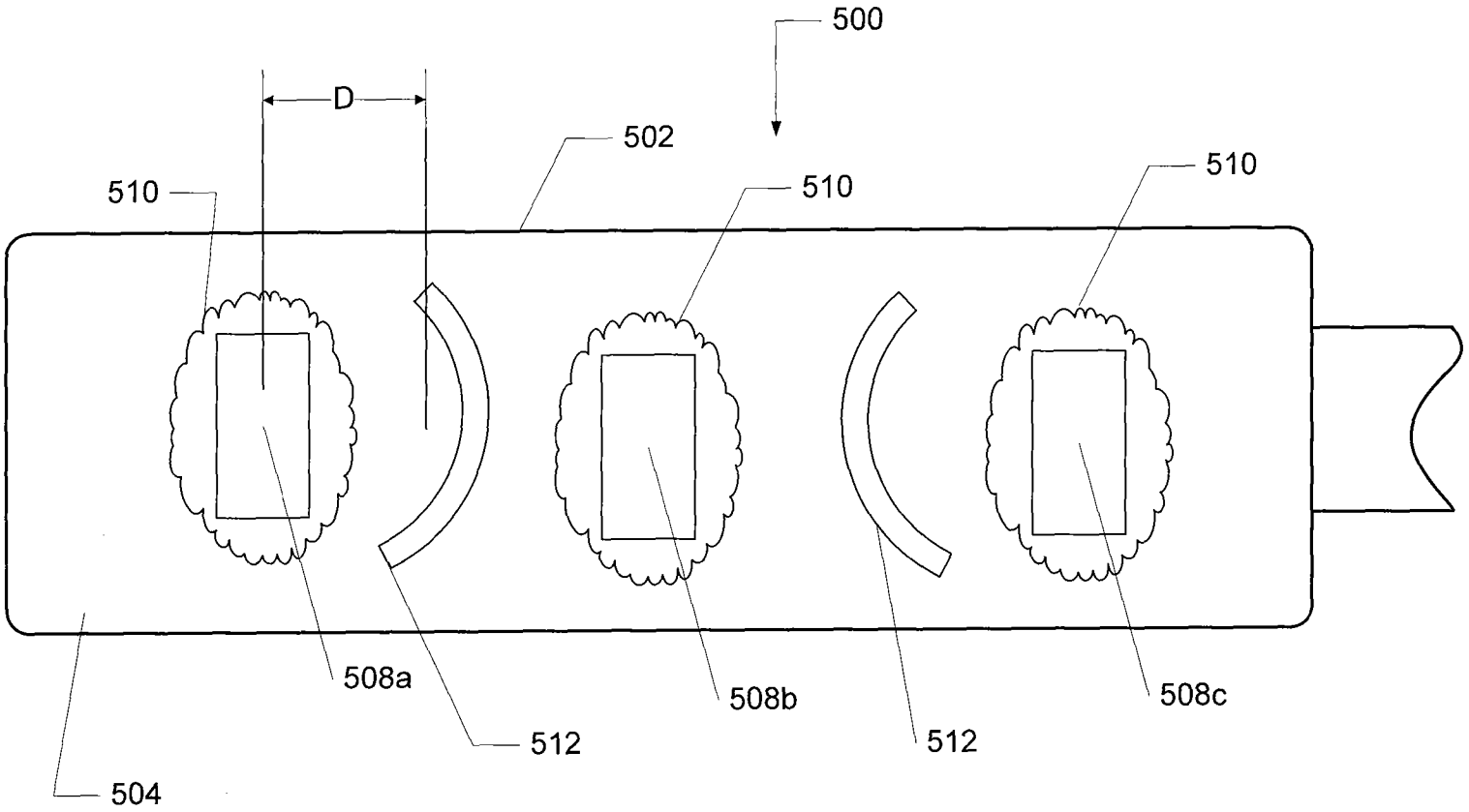
FIG. 23 is a rear view of an alternate arrangement of the toothbrush head of FIG. 21.

FIG. 23 illustrates another arrangement according to this embodiment. As shown, tooth cleaning elements 508 form a generally rectangular shape of a tuft of bristles. In another arrangement, the walls 512 are shown having a slight curvature. This curvature may aid in the shape of the walls 512 following the contour of the dome shaped membrane. The walls 512 may also be formed in alternate shapes to be tailored to the shapes of the tooth cleaning elements and to further enable movement of the tooth cleaning elements independently of the other tooth cleaning elements.

The embodiment described in which walls or dams are used to prevent molten nylon associated with each tooth cleaning element from fusing with molten nylon associated with another cleaning element enables the cleaning elements to move independently of each other. The distal tip of the tooth cleaning elements may move through a 360 degree arc, as indicated by arrow 330 in FIG. 18. In addition, the tooth cleaning elements may also move in a z-direction to allow tooth cleaning elements to encompass the tooth. This movement facilitates enhanced brushing of the lingual and facial surfaces with the dentifrice retained on the tooth cleaning element. In addition, z-direction movement of the tooth cleaning elements facilitates improved interproximal cleaning as well as cleaning of the crowns of the molars.

Although the subject matter has been described in language specific to certain structural features and/or methodological acts, it is to be understood that the subject matter defined in the appended claims is not necessarily limited to the specific features or acts described above. Rather, the specific features and acts described above are disclosed as example forms of implementing the claims. Numerous other embodiments, modifications and variations within the scope and spirit of the appended claims will occur to persons of ordinary skill in the art from a review of this disclosure.

What is claimed is:

1. A toothbrush comprising:

a handle;

a head extending from a proximal end to a distal end along a longitudinal axis, the head comprising a base portion formed of a rigid plastic material and a flexible portion formed of an elastomeric material coupled to the base portion, a first longitudinal section of the flexible portion spaced apart from the base portion by a gap that forms a transverse passageway through the head from a first side of the head to a second side of the head;

the flexible portion of the head having an upper surface, an opposing lower surface, a proximal end surface, and a distal end surface, wherein within the first longitudinal section of the flexible portion the upper surface and the lower surface are substantially planar and parallel to one another; and tooth cleaning elements secured to the flexible portion of the head by in-molded technology and extending from the upper surface of the flexible portion;

wherein the transverse passageway terminates in a first opening on the first side of the head and a second opening on the second side of the head; and wherein the proximal end surface is embedded in the base portion.

2. The toothbrush of claim 1 wherein a second longitudinal section of the flexible portion is coupled to the base portion at the distal end of the head and a third longitudinal section of the flexible portion is coupled to the base portion at the proximal end of the head, the first longitudinal section of the flexible portion being located between the second and third longitudinal sections of the flexible portion.

3. The toothbrush of claim 2 wherein the flexible portion of the head is fixedly coupled to the base portion of the head.

4. The toothbrush of claim 3 wherein an entirety of the upper surface of the flexible portion of the head is substantially planar.

5. The toothbrush of claim 4 wherein the flexible portion of the head is movable between: (1) a rest state wherein the upper surface of the flexible portion of the head is planar; and (2) a use state wherein the flexible portion of the head deflects into the gap and the upper surface of the flexible portion of the head is concave.

6. The toothbrush of claim 5 wherein the flexible portion of the head transitions from the rest state into the use state in response to pressure being applied to the upper surface of the flexible portion, the flexible portion automatically returning to the rest state upon release of the pressure.

7. The toothbrush of claim 6 wherein when the flexible portion of the head is in the rest state, the tooth cleaning elements extend from the upper surface of the flexible portion at varying heights.

8. The toothbrush of claim 1 wherein each of the first and second sides of the head extends between the proximal and distal ends of the head.

9. The toothbrush of claim 8 wherein each of the first and second openings is elongated in a direction of the longitudinal axis, and wherein a transverse axis that is perpendicular to the longitudinal axis intersects both of the first and second openings and the transverse passageway without intersecting the flexible portion of the head.

10. The toothbrush of claim 9 wherein the transverse passageway is visible from the first and second sides of the head.

11. The toothbrush of claim 1 wherein the base portion of the head has a top surface adjacent to the gap and an opposing bottom surface, and wherein the top surface is concave and the bottom surface is convex.

12. The toothbrush of claim 1 wherein the tooth cleaning elements comprise a first tooth cleaning element having a first length measured from the upper surface of the flexible portion to a proximal end and a second tooth cleaning element having a second length measured from the upper surface of the flexible portion to a proximal end, the first length being greater than the second length.

13. The toothbrush of claim 1 wherein the flexible portion of the head is movable between: (1) a rest state wherein the upper surface of the flexible portion of the head is planar; and (2) a use state wherein the flexible portion of the head deflects into the gap and the upper surface of the flexible portion of the head is concave.

14. The toothbrush of claim 1 wherein the upper surface of the flexible portion is planar while the flexible portion is coupled to the base portion and in a rest state.

15. A toothbrush comprising:

a handle;

a head extending from a proximal end to a distal end along a longitudinal axis, the head comprising a base portion formed of a rigid plastic material and a flexible portion formed of an elastomeric material, the flexible portion of the head fixedly coupled to the base portion of the head;

a first longitudinal section of the flexible portion spaced apart from the base portion by a gap, a second longitudinal section of the flexible portion coupled to the base portion at the distal end of the head, and a third longitudinal section of the flexible portion coupled to the base portion at the proximal end of the head, the first longitudinal section of the flexible portion being located between the second and third longitudinal sections of the flexible portion;

the flexible portion of the head having an upper surface and an opposing lower surface, wherein an entirety of the upper surface of the flexible portion is substantially planar and at least a portion of the lower surface of the flexible portion located within the first longitudinal section of the flexible portion is substantially planar and parallel to the upper surface of the flexible portion;

the base portion of the head having a top surface adjacent to the gap and an opposing bottom surface, and wherein the top surface is concave and the bottom surface has a convex portion that extends from the second longitudinal section of the flexible portion to the third longitudinal section of the flexible portion along the longitudinal axis; and tooth cleaning elements secured to the flexible portion of the head by in-molded technology, the tooth cleaning elements comprising a first tooth cleaning element having a first length measured from the upper surface of the flexible portion to a proximal end and a second tooth cleaning element having a second length measured from the upper surface of the flexible portion to a proximal end, the first length being greater than the second length.

16. The toothbrush of claim 15 wherein the gap forms a transverse passageway through the head from a first side of the head to a second side of the head, the transverse passageway being visible from the first and second sides of the head.

17. The toothbrush of claim 15 wherein the flexible portion of the head is movable between: (1) a rest state wherein the upper surface of the flexible portion of the head is planar; and (2) a use state wherein the flexible portion of the head deflects into the gap and the upper surface of the flexible portion of the head is concave and the lower surface of the flexible portion of the head is convex.

18. The toothbrush of claim 17 wherein the flexible portion of the head transitions from the rest state into the use state in response to pressure being applied to the upper surface of the flexible portion, the flexible portion automatically returning to the rest state upon release of the pressure.

19. The toothbrush of claim 15 wherein the upper surface of the flexible portion is planar while the flexible portion is coupled to the base portion and in a rest state.

* * * * *